US007779925B2

(12) United States Patent
Jacob

(10) Patent No.: US 7,779,925 B2
(45) Date of Patent: Aug. 24, 2010

(54) SEAL ASSEMBLY ENERGIZED WITH FLOATING PISTONS

(75) Inventor: Jean-Luc Jacob, Poey de Lescar (FR)

(73) Assignee: Weatherford/Lamb, Inc., Houston, TX (US)

( * ) Notice: Subject to any disclaimer, the term of this patent is extended or adjusted under 35 U.S.C. 154(b) by 806 days.

(21) Appl. No.: 11/550,590

(22) Filed: Oct. 18, 2006

(65) Prior Publication Data

US 2007/0056747 A1 Mar. 15, 2007

Related U.S. Application Data

(63) Continuation-in-part of application No. 11/422,467, filed on Jun. 6, 2006, now abandoned, which is a continuation of application No. 10/779,478, filed on Feb. 13, 2004, now Pat. No. 7,055,607.

(51) Int. Cl.
*E21B 33/128* (2006.01)

(52) U.S. Cl. ..... 166/386; 166/192

(58) Field of Classification Search ..... 166/375, 166/386, 192, 321, 126, 187
See application file for complete search history.

(56) References Cited

U.S. PATENT DOCUMENTS

| | | | | |
|---|---|---|---|---|
| 3,339,637 | A | 9/1967 | Holden | |
| 3,865,141 | A * | 2/1975 | Young | 137/629 |
| 4,252,197 | A * | 2/1981 | Pringle | 166/322 |
| 4,340,088 | A | 7/1982 | Geisow | |
| 4,420,043 | A | 12/1983 | Brooks | |
| 4,428,557 | A | 1/1984 | Yonker et al. | |
| 4,605,070 | A * | 8/1986 | Morris | 166/380 |
| 4,691,776 | A | 9/1987 | Pringle | |
| 4,729,433 | A | 3/1988 | Jacob et al. | |
| 4,834,175 | A | 5/1989 | Ross et al. | |
| 4,836,287 | A * | 6/1989 | Eric et al. | 166/321 |
| 5,305,828 | A | 4/1994 | White et al. | |
| 5,586,601 | A | 12/1996 | Pringle | |
| 6,902,008 | B2 | 6/2005 | Hirth et al. | |
| 7,055,607 | B2 | 6/2006 | Jacob | |

FOREIGN PATENT DOCUMENTS

| | | |
|---|---|---|
| GB | 2190941 | 12/1987 |
| GB | 2 366 579 | 3/2002 |

OTHER PUBLICATIONS

GB Search Report, Application No. GB0720337.5, dated Feb. 4, 2008.
UK Search Report, Application No. GB0502967.3, dated Jun. 7, 2005.

* cited by examiner

*Primary Examiner*—Daniel P Stephenson
(74) *Attorney, Agent, or Firm*—Patterson & Sheridan, LLP

(57) ABSTRACT

Methods and apparatus for sealing a plug within tubing that the plug is designed to be landed and set in are disclosed. The plug includes a seal assembly having a seal on the plug that is acted on by a piston. Wellbore fluid pressure acts on the piston when the valve is closed, thereby moving the piston to force the seal into sealing contact with an inside surface of the tubing.

23 Claims, 6 Drawing Sheets

SEAL ASSEMBLY ENERGIZED WITH FLOATING PISTONS

CROSS-REFERENCE TO RELATED APPLICATIONS

This application is a continuation-in-part of U.S. patent application Ser. No. 11/422,467, filed Jun. 6, 2006, now abandoned which is a continuation of U.S. patent application Ser. No. 10/779,478, filed Feb. 13, 2004, now U.S. Pat. No. 7,055,607. Each of the aforementioned related patent applications is herein incorporated by reference.

BACKGROUND OF THE INVENTION

1. Field of the Invention

Embodiments of the invention generally relate to tools having a seal assembly for sealing an annulus between a tubular seat in the wellbore and the outside of the tool disposed in the tubular seat.

2. Description of the Related Art

Surface-controlled, subsurface safety valves (SCSSVs) and plugs are commonly used to shut-in oil and/or gas wells. The SCSSV or plug fits into tubing in a hydrocarbon producing well and operates to block upward flow of formation fluid through the tubing. The tubing may include a landing nipple designed to receive the SCSSV or plug therein such that the SCSSV or plug may be installed and retrieved by wireline. During conventional methods for run-in of the SCSSV or plug to the landing nipple, a tool used to lock the SCSSV or plug in place within the nipple also temporarily holds the SCSSV or plug open until the SCSSV or plug is locked in place.

Most SCSSVs are "normally closed" valves, Le., the valves utilize a flapper type closure mechanism biased to a closed position. During normal production, application of hydraulic fluid pressure transmitted to an actuator of the SCSSV maintains the SCSSV in an open position. A control line that resides within the annulus between production tubing and a well casing may supply the hydraulic pressure to a port in the nipple that permits fluid communication with the actuator of the SCSSV. In many commercially available SCSSVs, the actuator used to overcome the bias to the closed position is a hydraulic actuator that may include a rod piston or concentric annular piston. During well production, the flapper is maintained in the open position by a flow tube acted on by the piston to selectively open the flapper member in the SCSSV. Any loss of hydraulic pressure in the control line causes the piston and actuated flow tube to retract, which causes the SCSSV to return to the normally closed position. Thus, the SCSSV provides a shutoff of production flow once the hydraulic pressure in the control line is released.

The landing nipple within the tubing may become damaged by operations that occur through the nipple prior to setting the SCSSV or plug in the landing nipple. For example, operations such as snubbing and tool running using coiled tubing and slick line can form gouges, grooves, and/or ridges along the inside surface of the nipple as the operations pass through the nipple. Further, any debris on the inside surface of the nipple or any out of roundness of the nipple may prevent proper sealing of the SCSSV or plug within the nipple. Failure of the SCSSV or plug to seal in the nipple due to surface irregularities in the inner diameter of the nipple can prevent proper operation of the actuator to open the SCSSV and can prevent the SCSSV or plug from completely shutting-in the well when the SCSSV or plug is closed since fluid can pass through the annular area between the SCSSV or plug and the nipple due to the irregularities. Operating the well without a safety valve or with a safety valve or plug that does not function properly presents a significant danger. Thus, the current solution to conserve the safety in wells having damaged nipples includes an expensive and time consuming work over to replace the damaged nipples.

Therefore, a need exists for improved apparatus and methods for disposing a plug or SCSSV within tubing regardless of whether the tubing has a damaged or irregular inside surface.

SUMMARY OF THE INVENTION

According to some embodiments, a plug for obstructing a bore of a tubing located in a well includes a mandrel, a seal disposed on an outer circumference of the mandrel, wherein the seal is compressible against an outer surface of the mandrel and an inner surface of the bore, and a piston disposed below the seal and movable relative to the mandrel to compress the seal in response to a pressure differential across the plug.

For some embodiments, a plug for obstructing a bore of a tubing located in a well includes a bore blocking assembly to divide the bore with a fluid tight seal, a moveable piston disposed on an outside of the assembly and having an outside diameter that forms initial sealing contact with an inside diameter of the bore, wherein the piston is exposed to wellbore fluid pressure in the bore below the plug, and a seal disposed on an outer circumference of the assembly, wherein the seal is compressible against an outer surface of the assembly and an inner surface of the bore in response to movement of the piston.

In yet other embodiments, a method of plugging a bore of a tubing located in a well includes disposing a plug in the bore, the plug having a mandrel, a seal disposed on an outer circumference of the mandrel, and a piston disposed below the seal, and creating a pressure differential across the piston due to wellbore fluid pressure below the plug acting on the piston, thereby urging the piston toward the seal to compress the seal into sealing contact with an outer surface of the mandrel and an inner surface of the bore.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

Embodiments of the invention generally relate to seal assemblies for any type of safety valve, dummy valve, straddle or plug designed to be landed and set within a tubular member. For some embodiments, the tubular member may form a ported landing nipple to enable fluid actuation of the safety valve, a side pocket mandrel, a sliding sleeve valve or a solid walled landing nipple. The seal assembly may be implemented with other variations of plugs, dummy valves, and subsurface safety valves different than exemplary configurations and designs shown and described herein since many operational details of these tools function independent of the seal assembly. For example, the seal assemblies may be used in all types of tools designed for landing in a nipple including wireline retrievable tools that may utilize flapper type valves or concentric type valves.

Figure 1:
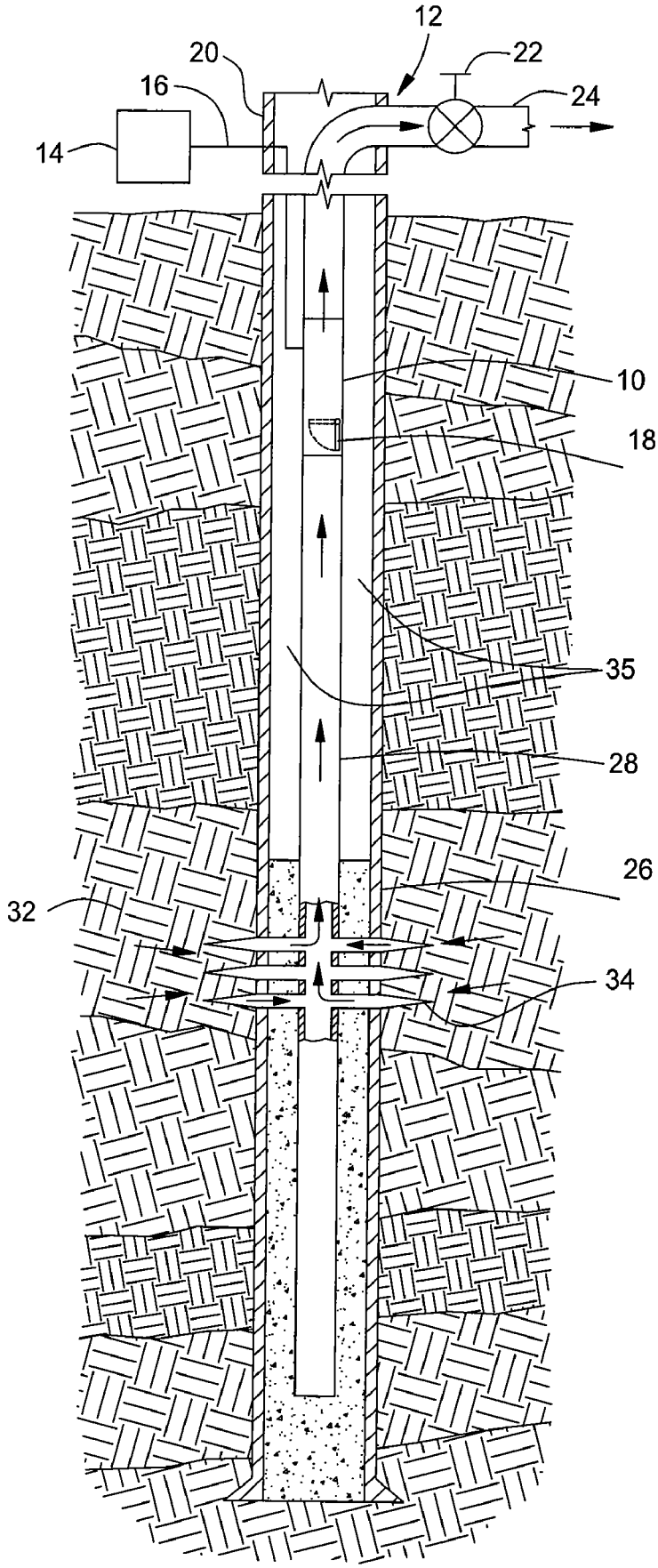
FIG. 1 is a schematic of a production well having a surface controlled, subsurface safety valve (SCSSV) installed therein.

FIG. 1 illustrates a production well 12 having an SCSSV 10 installed therein according to aspects of the invention as will be described in detail herein. While a land well is shown for the purpose of illustration, the SCSSV 10 may also be used in offshore wells. FIG. 1 further shows a wellhead 20, surface equipment 14, a master valve 22, a flow line 24, a casing string 26 and a production tubing 28. In operation, opening the master valve 22 allows pressurized hydrocarbons residing in the producing formation 32 to flow through a set of perforations 34 that permit and direct the flow of hydrocarbons into the production tubing 28. Hydrocarbons (illustrated by arrows) flow into the production tubing 28 through the SCSSV 10, through the wellhead 20, and out into the flow line 24. The SCSSV 10 is conventionally set in a profile within the production tubing 28. Surface equipment 14 may include a pump, a fluid source, sensors, etc. for selectively providing hydraulic fluid pressure to an actuator (not shown) of the SCSSV 10 in order to maintain a flapper 18 of the SCSSV 10 in an open position. A control line 16 resides within the annulus 35 between the production tubing 28 and the casing string 26 and supplies the hydraulic pressure to the SCSSV 10.

Figure 2:
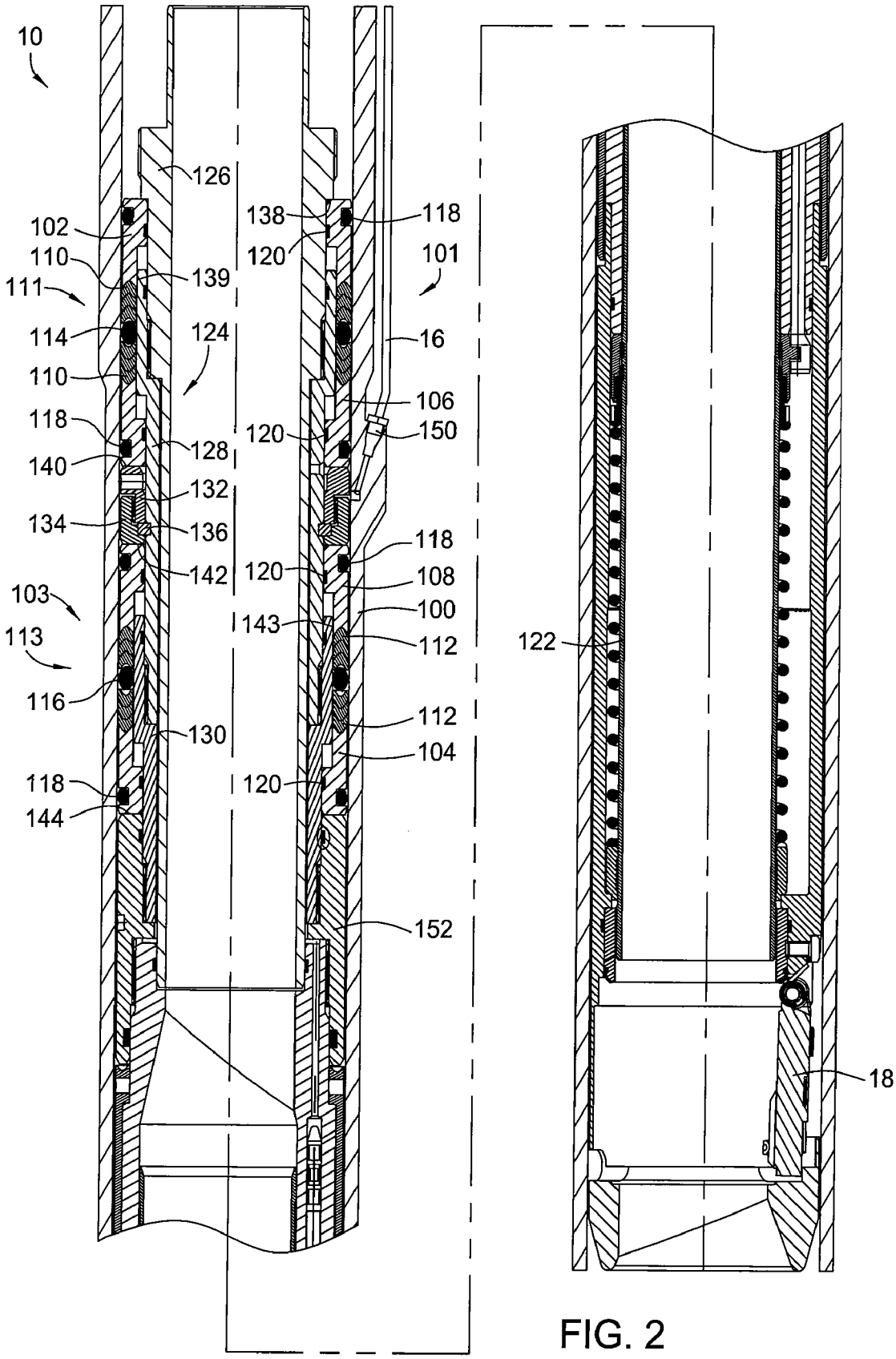
FIG. 2 is a sectional view of the SCSSV within a landing nipple during run-in of the SCSSV illustrating seal assemblies of the SCSSV in an uncompressed position.

FIG. 2 illustrates a sectional view of the SCSSV 10 within a landing nipple 100 in the production tubing. The SCSSV 10 is shown in a run-in position prior to setting of the SCSSV 10 within the landing nipple 100. As shown, the SCSSV 10 includes an upper and a lower seal assembly 101, 103 around an outside thereof, a packing mandrel 124 disposed inside the seal assemblies 101, 103 and an actuator/spring housing 152 connected to the lower end of the packing mandrel 124. The upper seal assembly 101 includes an upper compressible seal 111 formed by an upper sealing element 114 located between concave portions of upper V-seals or chevrons 110 on each side of the upper sealing element 114, an upper first piston 102 in contact with a top of the chevrons 110, and an upper second piston 106 in contact with a bottom of the chevrons 110. Similarly, the lower seal assembly 103 includes a lower compressible seal 113 formed by a lower sealing element 116 located between concave portions of lower V-seals or chevrons 112 on each side of the lower sealing element 116, a lower first piston 104 in contact with a bottom of the chevrons 112, and a lower second piston 108 in contact with a top of the chevrons 112. The pistons 102, 106, 108, 104 are preferably annular or concentric pistons. While both the upper and lower seal assemblies 101, 103 are shown in the embodiment in FIG. 2, the SCSSV 10 may include only one of either the upper or lower seal assemblies 101, 103. Additionally, other variations of the seals 111, 113 may be used so long as the pistons 102, 106, 108, 104 can operate to force the seals 111, 113 into sealing contact with the nipple 100.

The packing mandrel 124 includes an upper sub 126, a middle sub 128, and a lower sub 130 connected together such as by threads. However, the packing mandrel 124 may be made from an integral member or any number of subs. An annular shoulder 138 on the upper sub 126 provides a decompression stop for the upper first piston 102, which is slidable along a portion of an outer diameter of the upper sub 126. The upper compressible seal 111 located proximate to an increased outer diameter portion 139 of the middle sub 128 seals against the increased outer diameter portion 139. Additionally, the increased outer diameter portion 139 on the middle sub 126 provides a compression stop for both the upper first and second pistons 102, 106. A snap ring 136 fixed relative to the middle sub 126 engages a portion of an upper nut 132 connected to a lower nut 134 to secure the nuts 132, 134 relative to the middle sub. The upper and lower nuts 132, 134 located between the second pistons 106, 108 operate to longitudinally separate the upper and lower seal assemblies 111, 113. Thus, a face 140 of the upper nut 132 provides a decompression stop for the upper second piston 106 and a face 142 of the lower nut 134 provides a decompression stop for the lower second piston 108. Both the upper and lower second pistons 106, 108 are slidable along portions of the outer diameter of the middle sub 128 on each side of the nuts 132, 134. The lower compressible seal 113 located proximate to an increased outer diameter portion 143 of the lower sub 130 seals against the increased outer diameter portion 143. Additionally, the increased outer diameter portion 143 on the middle sub 126 provides a compression stop for both the lower first and second pistons 108, 104. An end face 144 of the actuator/spring housing 152 provides a decompression stop for the lower first piston 104.

The compression and decompression stops operate to limit the sliding movement of the pistons 102, 106, 108, 104 of the sealing assemblies 101, 103. Inner seals 120 on the inside of the pistons 102, 106, 108, 104 provide a seal between each piston and the packing mandrel 124 that the pistons slide along. Outer seals 118 on the outside of the pistons 102, 106, 108, 104 provide an initial seal between each piston and the nipple 100. The outer seals 118 may be soft O-rings with a large cross section to help ensure a sufficient initial seal between the pistons 102, 106, 108, 104 and the nipple 100. Thus, the initial seal provided by the outer seals 118 sufficiently seals against the nipple 100 such that fluid pressure applied to the large surface areas of the pistons 102, 106, 108, 104 that are shown in contact with the decompression stops 138, 140, 142, 144 causes the pistons to slide along the packing mandrel 124 toward the respective seal 111, 113.

In the run in position of the SCSSV 10 as shown in FIG. 2, the seal assemblies 101, 103 are in uncompressed positions with all the pistons 102, 106, 108, 104 contacting their respective decompression stops 138, 140, 142, 144. Therefore, the upper and lower seals 111, 113 are not compressed and may not provide sealing contact with the inside surface of the nipple 100 and the outside of the packing mandrel 124. During run-in all parts of the SCSSV 10 are in equal pressure so that the pistons 102, 106, 108, 104 do not move. In the run-in position, the SCSSV 10 is temporarily held open by a running tool (not shown) using a run-in prong or other temporary opening member. Since the SCSSV 10 is open, wellbore fluid pressure does not act on the first pistons 102, 104 to compress the upper and lower seals 111, 113. Further, fluid pressure is not supplied through the control line 16 such that the second pistons 102, 106 are also not acted on to compress the upper and lower seals 111, 113.

Once the SCSSV 10 is set or locked in the nipple 100 by conventional methods, the temporary opening member disengages and permits normal functioning of the SCSSV 10. Thus, the flapper 18 biases to a closed position unless fluid pressure is supplied through the control line 16 to a port 150 in the nipple 100 in order to actuate the SCSSV 10.

Figure 3:
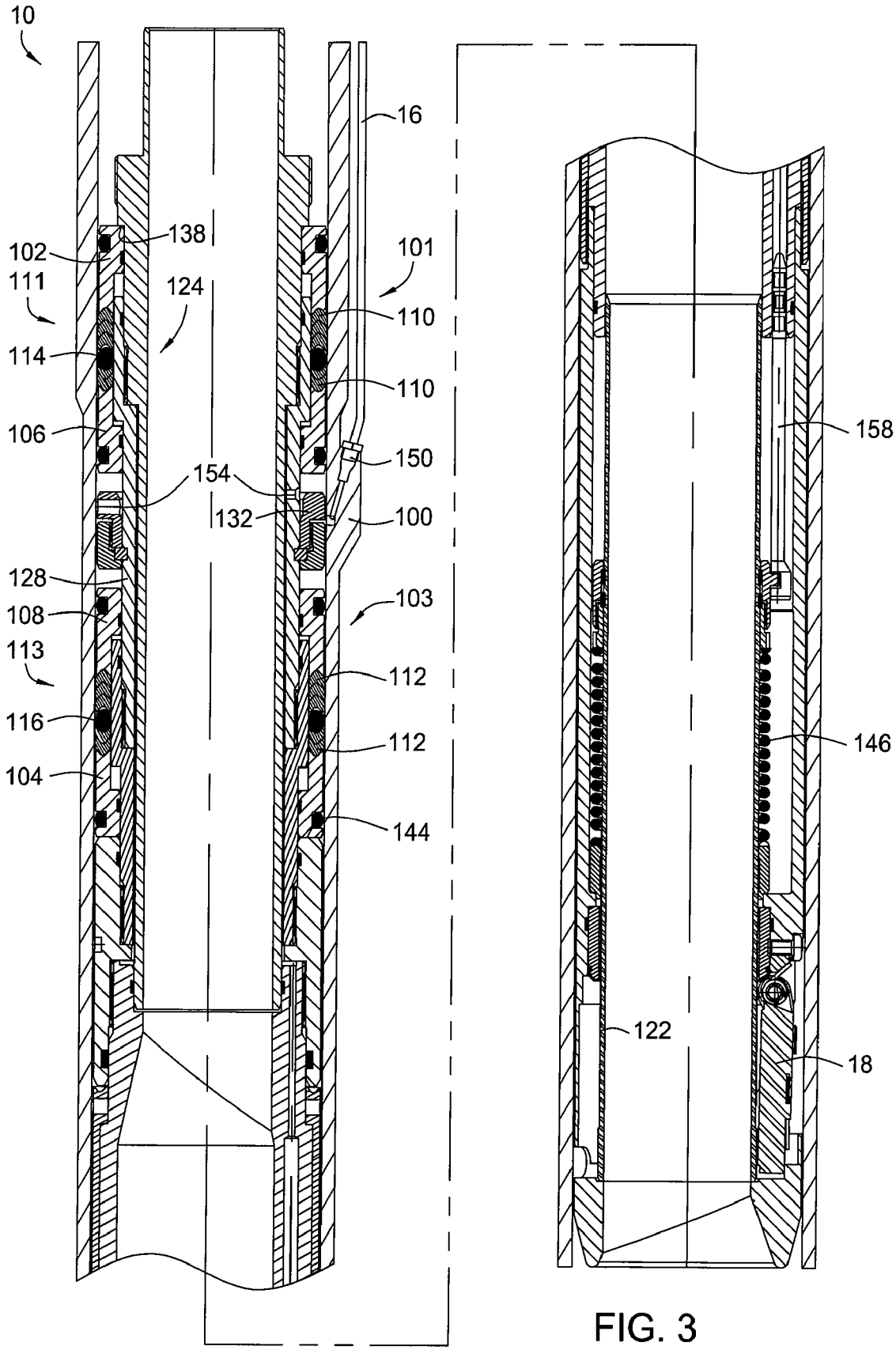
FIG. 3 is a sectional view of the SCSSV set in the nipple and actuated to an open position illustrating the seal assemblies in a first compressed position.

FIG. 3 is a sectional view of the SCSSV 10 in an actuated open position with the seal assemblies 101, 103 in a first compressed position. Fluid pressure supplied through the control line 16 to the port 150 in the nipple 100 passes through a fluid passageway 154 in the upper nut 132 and the middle sub 128 of the packing mandrel 124 into an annular area outside the upper sub 126. The fluid pressure acts on a piston rod 158 connected to a flow tube 122 to force the flow tube down against the bias of a biasing member such as a spring 146. The longitudinal displacement of the flow tube 122 causes the flow tube 122 to displace the flapper 18 and place the SCSSV 10 in the actuated open position. As an example of an SCSSV actuated by a concentric piston, the fluid pressure may alternatively act on an outward facing shoulder of a flow tube located concentrically within the packing mandrel to force the flow tube down and open a flapper.

The fluid pressure supplied through the control line 16 used to actuate and open the SCSSV 10 additionally operates to place the seal assemblies 101, 103 in the first compressed position. The fluid pressure supplied from the control line 16 enters the port 150 where the fluid enters the interior of the nipple 100 and acts on the second pistons 106, 108 to slide the second pistons toward the respective seals 111, 113. Any wellbore pressure on the first pistons 102, 104 is less than that on the second pistons 106, 108 such that the first pistons 102, 104 remain in contact with their respective decompression stops 138, 144. The sliding movement of the second pistons 106, 108 pushes on the chevrons 110, 112, which in turn pushes on the sealing members 114, 116. Compression of the seals 111, 113 caused by the sliding of the second pistons 106, 108 forces the sealing members 114, 116 and/or the chevrons 110, 112 into sealing contact with the inside surface of the nipple 100. Preferably, the sealing members 114, 116 are soft O-rings with a large cross section made from a material such as Viton® (65 duro). Additionally, the chevrons 110, 112 are preferably made from a material such as Kevlar® filled Viton®. Once the SCSSV is actuated open, wellbore fluid passes through the SCSSV 10 such that wellbore fluid pressure does not act to slide the first pistons 102, 104, and the first pistons 102, 104 remain in contact with their respective decompression stops 138, 144.

Figure 4:
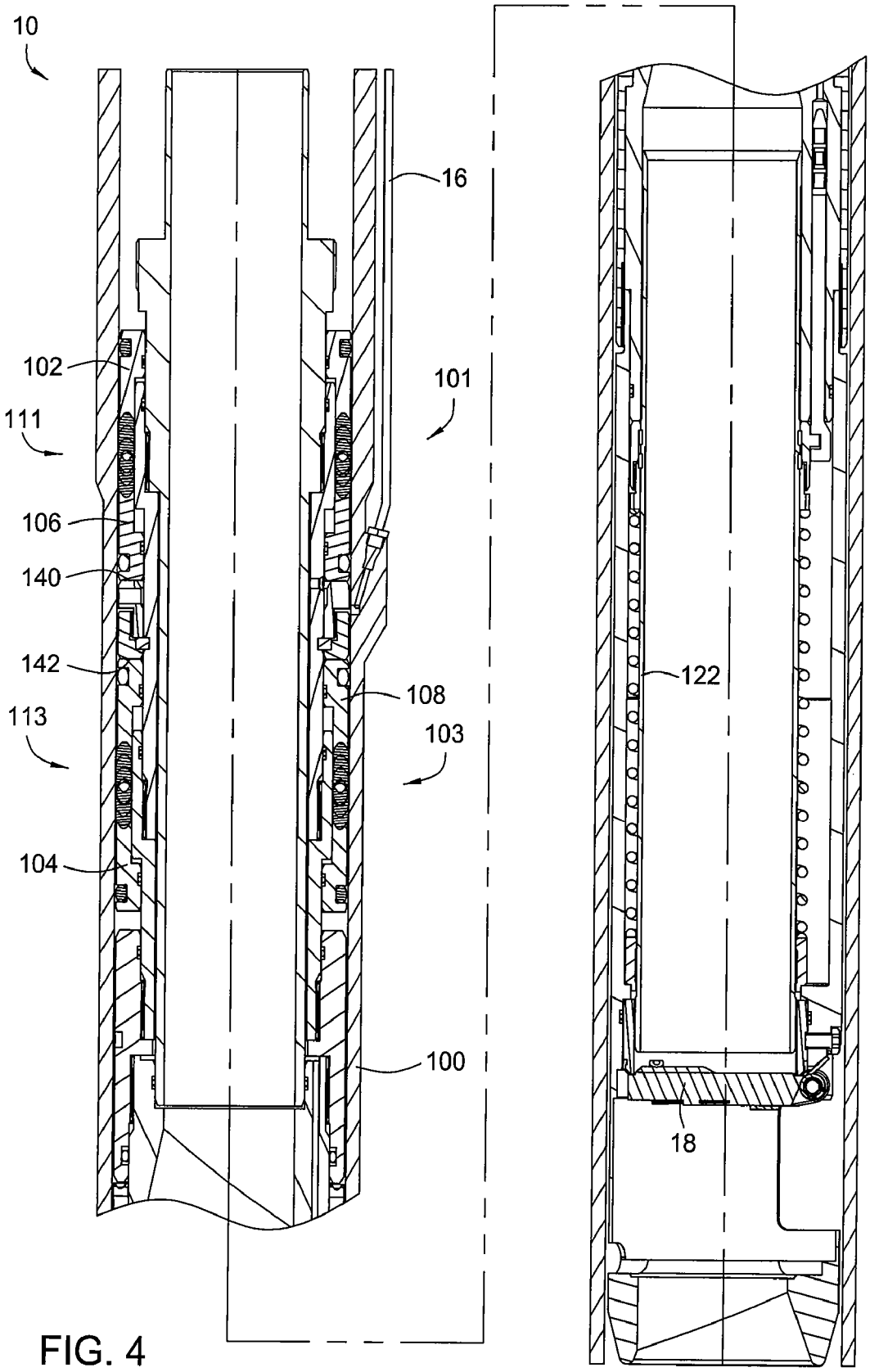
FIG. 4 is a sectional view of the SCSSV set in the nipple and biased to a closed position illustrating the seal assemblies in a second compressed position.

FIG. 4 is a sectional view of the SCSSV 10 set in the nipple 100 and biased to the closed position with the seal assemblies 101, 103 in a second compressed position and the flapper 18 blocking fluid flow through the SCSSV 10. As fluid pressure bleeds from the control line 16 during closure of the SCSSV 10, the fluid pressure acting on the second pistons 106, 108 approaches hydrostatic pressure, which along with the wellbore pressure acting on the first pistons 102, 104 keeps the seals 111, 113 compressed. When the wellbore pressure is greater than the pressure supplied by the control line 16, the wellbore pressure acts on the first pistons 102, 104 to slide the first pistons toward the respective seals 111, 113. For example, wellbore fluid pressure above the SCSSV 10 acts on the upper first piston 102, and wellbore fluid pressure below the SCSSV 10 acts on the lower first piston 104. The second pistons 106, 108 slide into contact with their respective decompression stops 140, 142. The sliding movement of the first pistons 102, 104 pushes on the chevrons 110, 112, which in turn pushes on the sealing members 114, 116. Therefore, compression of the seals 111, 113 caused by the sliding of the first pistons 102, 104 maintains sealing contact with the inside surface of the nipple 100 since the sealing members 114, 116 and/or the chevrons 110, 112 remain forced against the inside surface of the nipple 100.

In both the first and second compressed positions as illustrated by FIGS. 3 and 4 respectively, the upper and/or the lower seals 111, 113 form a fluid seal with an inside surface of the nipple 100 that may have irregularities, grooves, recesses, and/or ridges that would prevent prior SCSSVs from properly sealing within the nipple 100. Additionally, the sealing ability of the upper and/or the lower seals 111, 113 with the chevrons 110, 112 around the sealing members 114, 116 increases with increased pressure to the pistons 102, 106, 108, 104. As shown, the SCSSV provides a large inner diameter flow path, and the seal assemblies 101, 103 do not reduce or significantly reduce the inner diameter flow path through the SCSSV 10.

A method for sealing a SCSSV within a nipple located in a well is provided by aspects of the invention. The method includes locating the SCSSV in the nipple using conventional running methods. The SCSSV includes at least one seal assembly disposed about an outer surface thereof, and the at least one seal assembly includes a seal, a first piston disposed on a first side of the seal, and a second piston disposed on a second side of the seal. Urging the first piston, the second piston or both the first and second piston toward the seal forces the seal into sealing contact with an inside surface of the nipple. Urging the first piston is caused by wellbore fluid pressure applied to the first piston when the SCSSV is closed. Urging the second piston is caused by fluid pressure supplied from a control line to a fluid port in fluid communication with an inside portion of the nipple.

Figure 5:
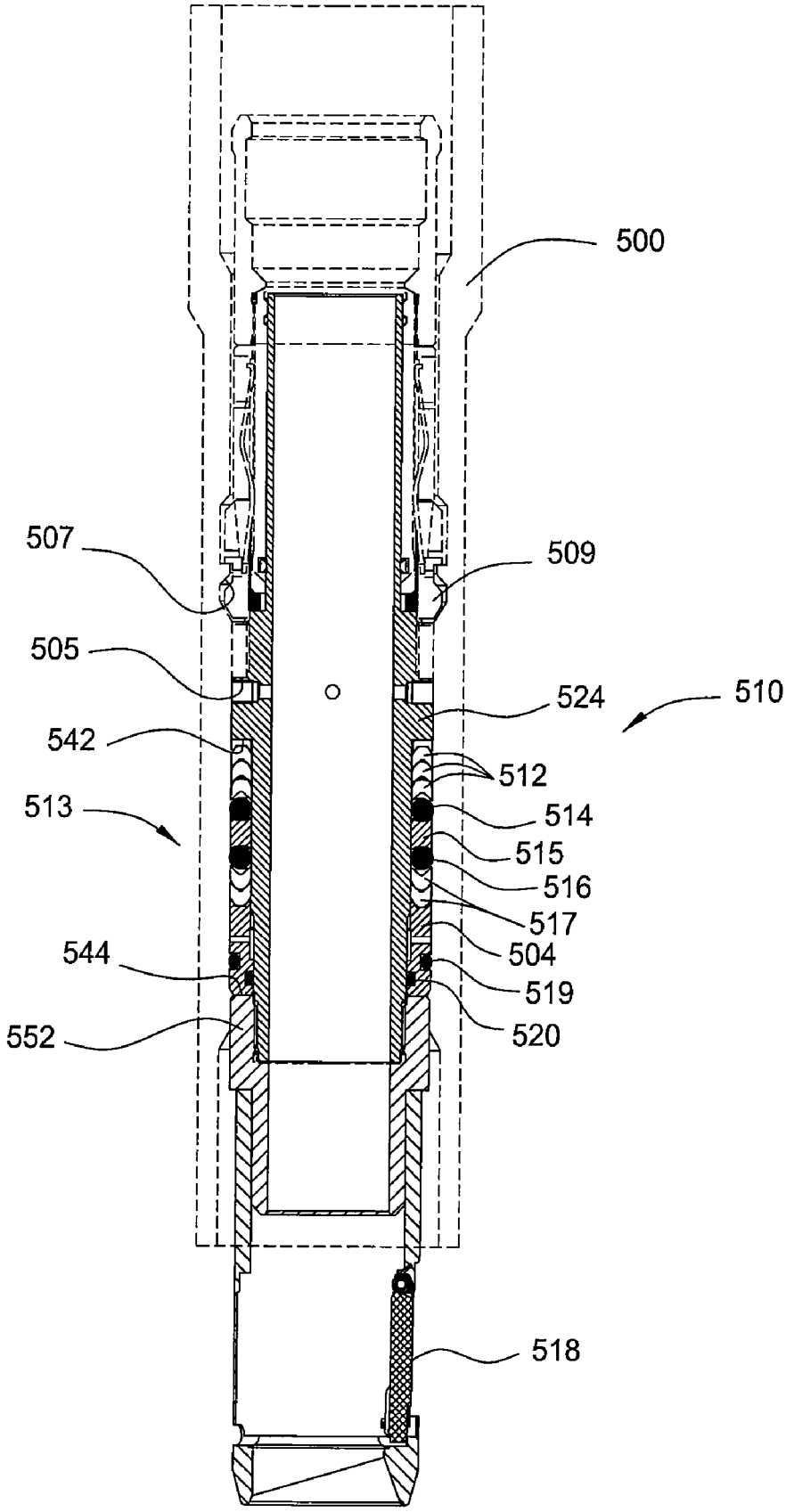
FIG. 5 is a sectional view of a plug within a landing nipple during run-in of the plug illustrating a seal assembly of the plug in an uncompressed position.

FIG. 5 illustrates a sectional view of a plug 510 within a landing nipple 500 during run-in of the plug 510 such that a compressible seal 513 of the plug 510 remains in an uncompressed position. The plug 510 includes the seal 513 around an outside thereof, a packing mandrel 524 disposed inside the seal 513, and a lower bore closure housing 552 coupled to the lower end of the packing mandrel 524. The seal 513 may include a middle ring 515 disposed between first and second sealing elements 514, 516 with the first sealing element 514 located adjacent concave portions of first V-seals or chevrons 512 and the second sealing element 516 disposed proximate concave portions of second V-seals or chevrons 517. The middle ring 515 may support without compressing and space the sealing elements 514, 516 from one another during squeezing of elastomeric material making up the sealing elements 514, 516. A sliding piston 504, such as an annular or concentric piston, bears on the second chevrons 517 either through direct contact at one end of the piston 504 with convex portions of the second chevrons 517 or through indirect coupling. The bore closure housing 552 contains the piston 504 and seal 513 in place around the mandrel 524 between an end face 544 of the bore closure housing 552 and an outward shoulder 542 of the mandrel 524.

During run-in of the plug 510, a running tool (not shown) using a run-in prong or other temporary opening member temporarily holds the plug 510 open by, for example, displacing a flapper valve 518. Since the plug 510 is open, wellbore fluid pressure does not act on the piston 504 to compress the seal 513. All parts of the plug 510 remain in equal pressure in the run-in position so that the piston 504 does not move from resting against the end face 544 of the bore closure housing 552. One or more ports 505 through the wall of the packer mandrel 524 may ensure that no differential pressure occurs across the piston 504 during run-in since both sides of the piston 504 are therefore at the wellbore pressure. The seal 513 while uncompressed may not provide sealing contact with the inside surface of the nipple 500 and the outside of the packing mandrel 524.

For some embodiments, mechanical setting of the plug 510 in the nipple includes engaging dogs 509 on the plug 510 within a profile 507 in the nipple 500. Once the plug 510 is set or locked in the nipple 500, the temporary opening member disengages and permits closure of the plug 510. The disengagement may occur upon retrieval of the running tool. According to some embodiments, biasing or otherwise moving the flapper valve 518 to a closed position obstructs, blocks and/or seals the bore of the nipple 500.

Figure 6:
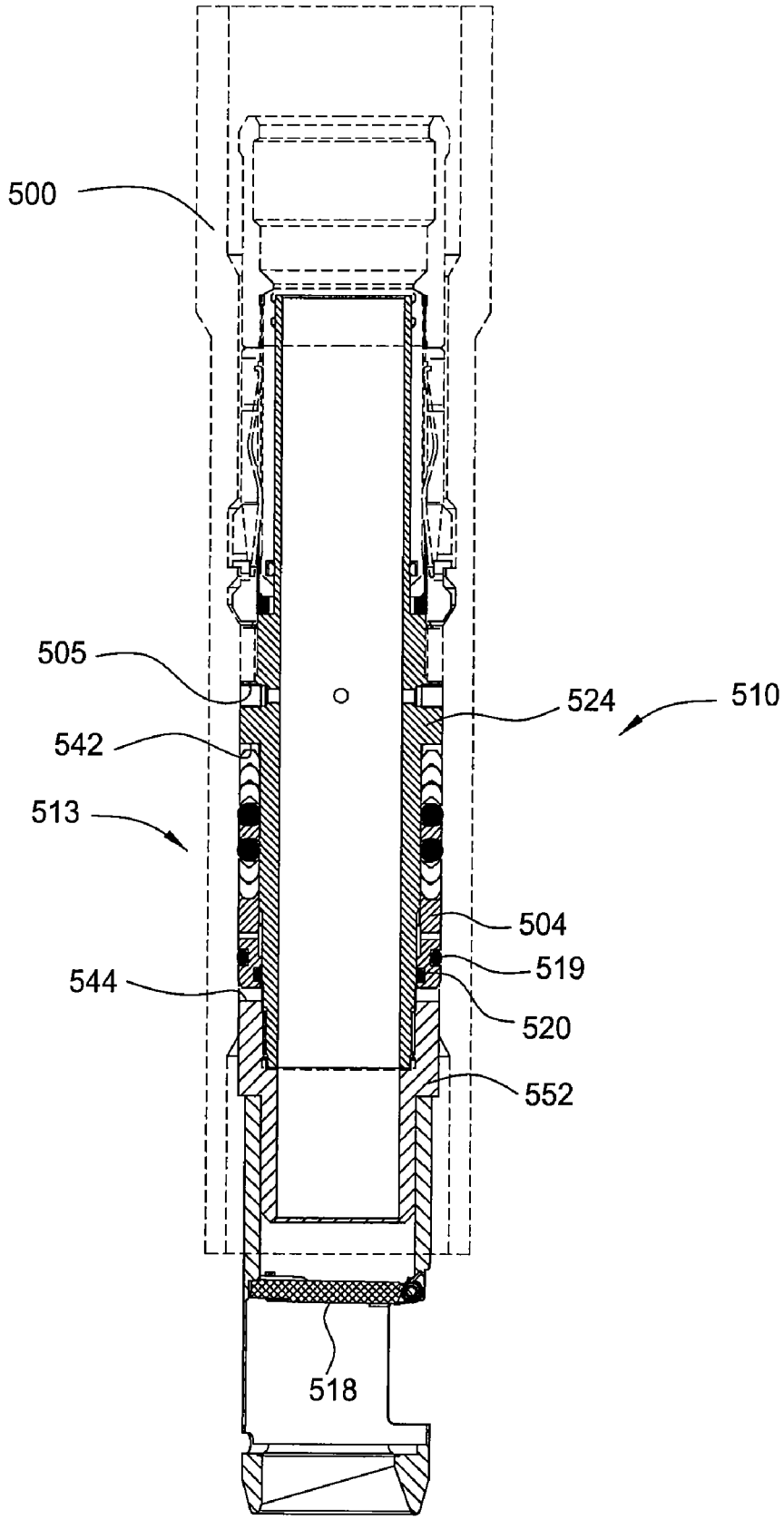
FIG. 6 is a sectional view of the plug set in the nipple and closed illustrating the seal assembly in a compressed position.

FIG. 6 shows a sectional view of the plug 510 in a closed position and set in the nipple 500 with the seal 513 in a compressed position. Once the plug is closed, bleeding off pressure above the plug 510 occurs to relieve pressure at the wellhead. Inner seal 520 on the inside of the piston 504 provides a seal between the piston 504 and the packing mandrel 524 that the piston 504 slides along. Outer seal 519 on the outside of the piston 504 provides an initial seal between the piston 504 and the nipple 500. The outer seal 519 may be a soft O-ring with a large cross section to help ensure a sufficient initial sealing between the piston 504 and the nipple 500. Thus, wellbore fluid pressure applied to the piston 504 causes the piston 504 to slide along the packing mandrel 524 toward the seal 513 due to the initial sealing against the nipple 500 provided by the outer seal 504. Once locked in place, the mandrel 524 remains stationary with respect to the nipple 500 such that movement of the piston 504 occurs relative to the mandrel 524 and the nipple 500.

In operation, the bleeding of pressure from above the plug 510 may create a pressure differential across the piston 504. Accordingly, wellbore pressure below the piston 504 acts on the piston 504 to urge the piston 504 toward the seal 513 as the bleeding lowers the pressure above the piston 504. The ports 505 may facilitate draining of pressurized fluid above the piston 504 during the bleeding. The piston 504 then slides along a portion of an outer diameter of the packing mandrel 524 to push the seal 513 against the shoulder 542 of the mandrel 524. In response to the movement of the piston 504, the seal 513 must occupy a shorter longitudinal distance accommodated for by an increase in radial volume of the seal 513. The seal 513 hence compresses against the outside of the mandrel 524 and the inside of the nipple 500 to ensure fluid tight separation between areas above and below the plug 510. Lack of movement between the mandrel 524 and the nipple 500 during this active contact with respective inner and outer surfaces of the seal 513 prevents excess binding and wear of the seal 513.

The seal 513 forms a fluid seal with the inside surface of the nipple 500 that may have irregularities, grooves, recesses, and/or ridges that would prevent prior plugs from properly sealing within the nipple 500. Additionally, the sealing ability of the seal 513 with the chevrons 512, 517 around the sealing elements 514, 516 increases with increased pressure to the piston 504. Any increase in pressure below the plug 504 therefore tends to improve sealing properties and thereby ensure safe containment of fluids below the plug 504.

While the foregoing is directed to embodiments of the present invention, other and further embodiments of the invention may be devised without departing from the basic scope thereof, and the scope thereof is determined by the claims that follow.

What is claimed is:

1. A plug for obstructing a bore of a tubing located in a well, comprising:

a mandrel;

a seal disposed on an outer circumference of the mandrel, wherein the seal is compressible against an outer surface of the mandrel and an inner surface of the bore; and a piston disposed on the outer circumference of the mandrel below the seal and movable relative to the outer circumference of the mandrel, while the outer circumference of the mandrel is stationarily fixed relative to the bore, to compress the seal in response to a pressure differential across the plug.

2. The plug of claim 1, wherein the piston includes inner and outer sealing elements disposed thereon.

3. The plug of claim 1, wherein the seal is disposed between an end of the piston and an outward shoulder of the mandrel.

4. The plug of claim 1, wherein a first end of the piston contacts the seal and an opposite second end of the piston is exposed to wellbore fluid pressure below the plug.

5. The plug of claim 1, further comprising an interlock to secure the plug within the bore.

6. The plug of claim 5, wherein the interlock includes dogs on the plug for receipt into a profile in the bore.

7. The plug of claim 1, further comprising a valve to temporarily open a passage through the plug while open and divide the bore with a fluid tight seal while closed.

8. The plug of claim 1, wherein a flow path permits fluid communication between an area above the plug and an annular region above the seal and a first end of the piston, and wherein a second end of the piston is exposed to wellbore fluid pressure below the plug.

9. The plug of claim 1, further comprising an aperture through a wall of the mandrel.

10. The plug of claim 1, further comprising an aperture through a wall of the mandrel with the seal disposed between the aperture and a first end of the piston, wherein the aperture is in fluid communication with an open area of the bore above the plug and a second end of the piston is exposed to wellbore fluid pressure in an open area of the bore below the plug.

11. The plug of claim 1, wherein the seal comprises a plurality of chevron seals on each side of a sealing element with concave portions of the chevron seals directed toward the sealing element.

12. The plug of claim 1, wherein the seal comprises a middle ring disposed between first and second sealing elements with the first sealing element located adjacent concave portions of first chevrons and the second sealing element disposed proximate concave portions of second chevrons.

13. A plug for obstructing a bore of a tubing located in a well, comprising:

a bore blocking assembly to divide the bore with a fluid tight seal;

a piston disposed on and movable relative to an outer circumference of the assembly, while the outer circumference of the assembly is stationarily fixed relative to the bore, and having an outside diameter that forms initial sealing contact with an inside diameter of the bore, wherein the piston is exposed to wellbore fluid pressure in the bore below the plug; and a seal disposed on the outer circumference of the assembly, wherein the seal is compressible against an outer surface of the assembly and an inner surface of the bore in response to movement of the piston.

14. The plug of claim 13, wherein the piston includes inner and outer sealing elements disposed thereon.

15. The plug of claim 13, wherein the bore blocking assembly mates with a landing nipple of the tubing.

16. The plug of claim 15, further comprising an interlock to secure the bore blocking assembly within the landing nipple.

17. The plug of claim 13, further comprising a valve to temporarily open a passage through the bore blocking assembly while open and divide the bore while closed.

18. A method of plugging a bore of a tubing located in a well, comprising:

disposing a plug in the bore, the plug having a mandrel, a seal disposed on an outer circumference of the mandrel, and a piston disposed on and movable relative to the outer circumference of the mandrel below the seal;

creating a pressure differential across the piston due to wellbore fluid pressure below the plug acting on the piston, thereby urging the piston toward the seal to compress the seal into sealing contact with an outer surface of the mandrel and an inner surface of the bore; and moving the piston along the outer surface of the mandrel while the mandrel remains stationary relative to the bore.

19. The method of claim 18, wherein creating the pressure differential includes closing the plug and bleeding pressure from above the plug.

20. The method of claim 18, wherein disposing the plug in the bore includes landing the plug in a nipple to contact an outside diameter of the piston with an inside diameter of the nipple, thereby forming initial sealing contact.

21. A plug for obstructing a bore of a tubing located in a well, comprising:

a mandrel;

a seal disposed on an outer circumference of the mandrel, wherein the seal is compressible against an outer surface of the mandrel and an inner surface of the bore;

a piston disposed below the seal and movable relative to the mandrel to compress the seal in response to a pressure differential across the plug; and an aperture through a wall of the mandrel with the seal disposed between the aperture and a first end of the piston, wherein the aperture is in fluid communication with an open area of the bore above the plug and a second end of the piston is exposed to wellbore fluid pressure in an open area of the bore below the plug.

22. A plug for obstructing a bore of a tubing located in a well, comprising:

a mandrel;

a seal disposed on an outer circumference of the mandrel, the seal comprising a plurality of chevron seals on each side of a sealing element with concave portions of the chevron seals directed toward the sealing element, wherein the seal is compressible against an outer surface of the mandrel and an inner surface of the bore; and a piston disposed below the seal and movable relative to the mandrel to compress the seal in response to a pressure differential across the plug.

23. A method of plugging a bore of a tubing located in a well, comprising:

disposing a plug in the bore, the plug having a mandrel, a seal disposed on an outer circumference of the mandrel, and a piston disposed below the seal, wherein disposing the plug in the bore includes landing the plug in a nipple to contact an outside diameter of the piston with an inside diameter of the nipple, thereby forming initial sealing contact; and creating a pressure differential across the piston due to wellbore fluid pressure below the plug acting on the piston, thereby urging the piston toward the seal to compress the seal into sealing contact with an outer surface of the mandrel and an inner surface of the bore.

* * * * *